US005685049A

United States Patent [19]

Wu

[11] Patent Number: 5,685,049

[45] Date of Patent: Nov. 11, 1997

[54] ALLOY BUTTON FOR JEANS

[76] Inventor: Hung-Ming Wu, P.O. Box 82-144, Taipei, Taiwan

[21] Appl. No.: 528,709

[22] Filed: Sep. 15, 1995

[51] Int. Cl.[6] ..... A44B 1/42

[52] U.S. Cl. ..... 24/95; 24/94

[58] Field of Search ..... 24/94, 95, 113 MP, 24/113 R, 621, 691, 90.1

[56] References Cited

U.S. PATENT DOCUMENTS

| | | | |
|---|---|---|---|
| 3,320,644 | 5/1967 | Daddona, Jr. | 24/95 |
| 3,577,846 | 5/1971 | Perrin | 24/95 |
| 4,097,969 | 7/1978 | Nysten | 24/94 X |
| 4,512,063 | 4/1985 | Fukuroi | 24/95 X |
| 4,570,307 | 2/1986 | Kanzaka | 24/95 |
| 4,571,780 | 2/1986 | Fukuroi | 24/95 |
| 4,607,415 | 8/1986 | Fukuroi | 24/94 |
| 4,809,407 | 3/1989 | Watanabe | 24/95 |
| 4,813,106 | 3/1989 | Fukushima | 24/95 X |
| 4,815,173 | 3/1989 | Watanabe | 24/95 X |

*Primary Examiner*—Peter M. Cuomo
*Assistant Examiner*—Robert J. Sandy
*Attorney, Agent, or Firm*—Alfred Lei

[57] ABSTRACT

An alloy button including a socket member, and a stud for fastening to the socket member to secure it to the cotton fabric of a piece of garment, the socket member having a cylindrical socket body, an axial mounting hole defined within the socket body, a tapered bottom hole at one end of the socket body for guiding the plain end of the stud into the axial mounting hole, a coupling hole at one end of the axial mounting hole remote from the tapered bottom hole for retaining the plain end of the stud, a tapered flange outwardly raised from one end of the socket body around the coupling hole, and a tapered top hole defined within the tapered flange and covered with an ornamental cap.

1 Claim, 5 Drawing Sheets

ALLOY BUTTON FOR JEANS

BACKGROUND OF THE INVENTION

1. Field of the Invention

The present invention relates to alloy buttons for jeans which are easy to manufacture and convenient to install.

2. Description of the Prior Art

Because bronze is rustproof and corrosion resisting, it is commonly used for manufacturing buttons for jeans. FIG. 1 show the structure of a metal button for jeans according to the prior art, which is comprised of a stud A4', a socket member A2, an impact plate A3, and a cap A1. Before the installation of the button, the cap A1 is fastened to the socket member A1 to hold the impact plate A3 on the inside. During the installation procedure, the stub A4' is attached to the cotton cloth of the garment at one side, permitting its plain end to pierce the cotton cloth, then the socket member A2 is attached to the cotton cloth of the garment at an opposite side and mounted around the plain end of the stud A4', and then a pressure is given to the cap A1 against the stud A4' to deform the plain end of the stub A4' (see FIG. 2), and therefore the socket member A2 is fastened to the cotton cloth of the garment by the stud A4'. This structure of metal button consists of several parts, its manufacturing cost is high. Another drawback of this structure of metal button is that when the cap A1, the socket member A2, and the impact plate A3 are respectively made, they must be assembled together by stamping. Furthermore, when the cap A1 is fastened to the socket member A2, the acute angle of the peripheral edge A5 of the cap A1 is not protected, therefore, the worker or user's fingers ten to be injured when touching the peripheral edge A5 of the cap A1.

SUMMARY OF THE INVENTION

The present invention has been accomplished to provide alloy buttons for jeans which eliminate the aforesaid drawbacks.

According to one embodiment of the present invention, the alloy button comprises a socket member, and a stud for fastening to the socket member to secure it to the cotton fabric of a piece of garment, wherein the socket member comprises a cylindrical socket body, an axial mounting hole defined within the socket body, a tapered bottom hole at one end of the socket body for guiding the plain end of the stud into the axial mounting hole, a coupling hole at one end of the axial mounting hole remote from the tapered bottom hole for retaining the plain end of the stud, a tapered flange outwardly raised from one end of the socket body around the coupling hole, and a tapered top hole defined within the tapered flange and covered with an ornamental cap.

According to another embodiment of the present invention, the alloy button comprises a socket member, and a stud having a head and a plain end for fastening to the socket member to secure it to the cotton fabric of a piece of garment, wherein the socket member comprises a cylindrical socket body, a dome-like head at one end of the socket body, an axial mounting hole, which is a blind hole defined within the socket body, a tapered bottom hole at one end of the socket body for guiding the plain end of the stud into the axial mounting hole, a radial coupling hole at one end of the socket body adjacent to the dome-like head and in communication with the axial mounting hole for retaining the plain end of the stud when it is deformed by force, and a reinforcing rib connected between the socket body and the dome-like head.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
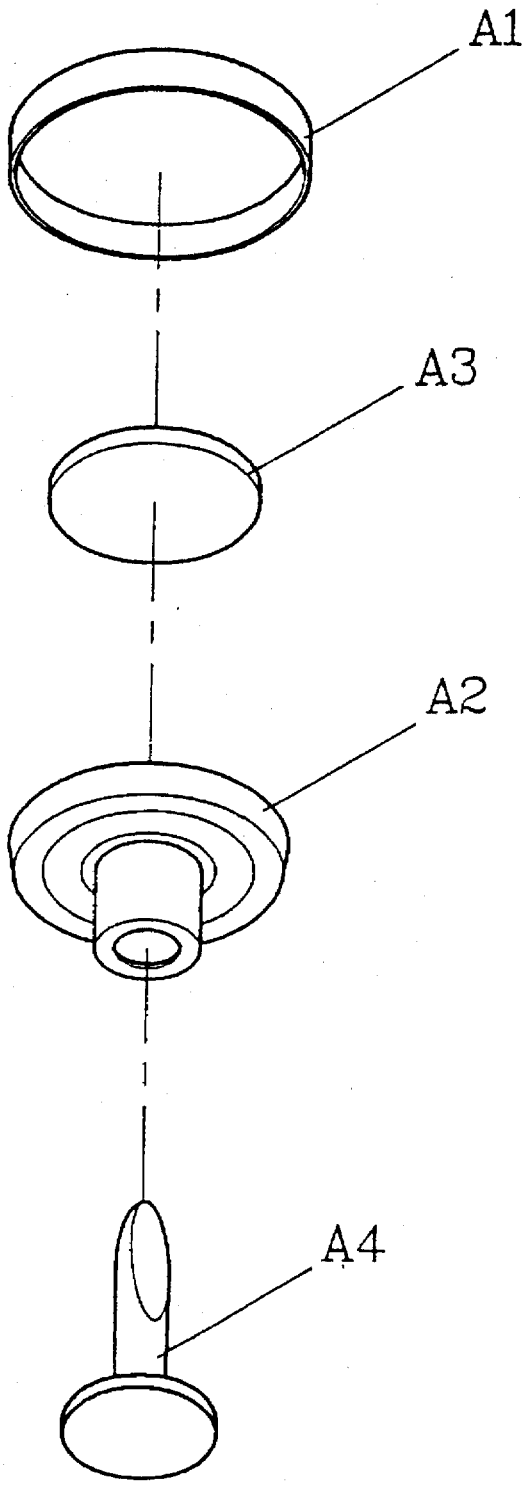
PRIOR ART FIG. 1
FIG. 1 is an exploded view of a metal button for jeans according to the prior art.
Figure 2:
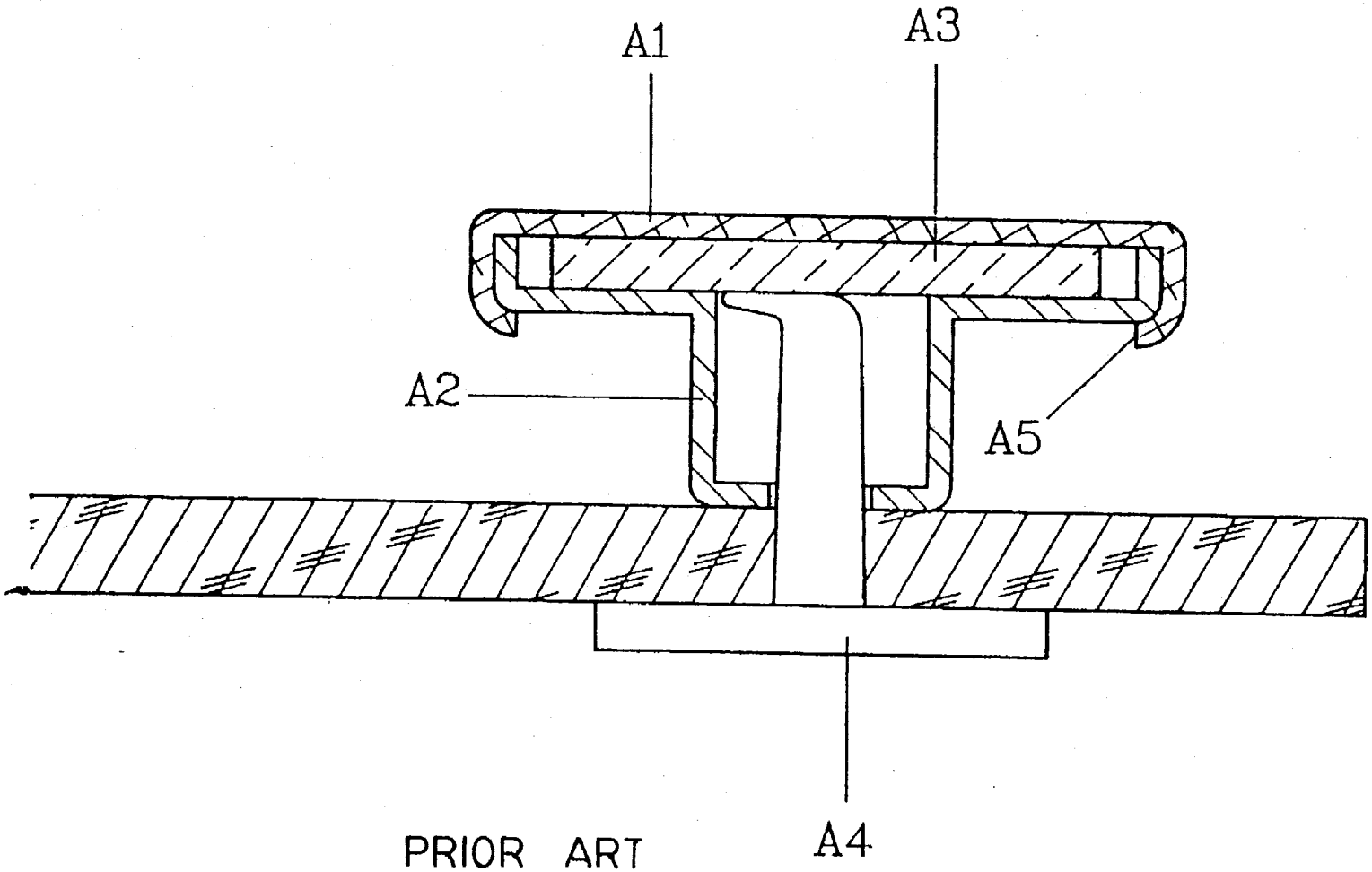
PRIOR ART FIG. 2
FIG. 2 is a sectional view showing the metal button of FIG. 1 assembled.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 3:
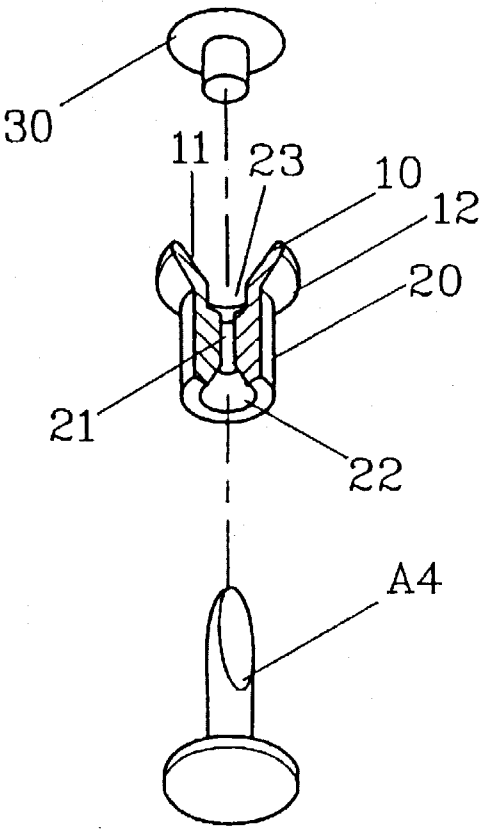
FIG. 3 is an exploded view of an alloy button for jeans according to a first embodiment of the present invention.

Referring to FIG. 3, an alloy button for jeans in accordance with the present invention is generally comprised of a socket member 10, a stud A4, and an ornamental cap 30 respectively made from alloy by stamping. The socket member 10 comprises a cylindrical socket body 20, an axial mounting hole 21 defined within the socket body 20, a tapered bottom hole 22 at one end of the axial mounting hole 21, a coupling hole 23 at an opposite end of the axial mounting hole 21, a tapered flange 12 outwardly raised from one end of the socket body 20 around the coupling hole 23, and a tapered top hole 11 defined within the tapered flange 12.

Figure 4:
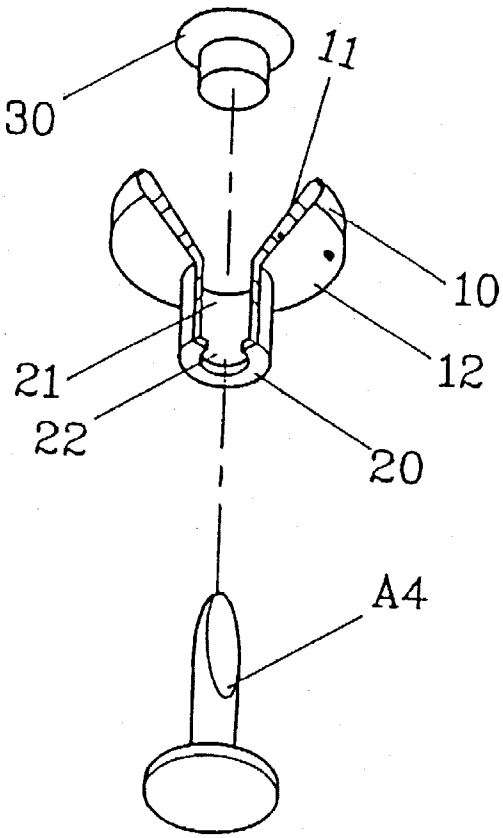
FIG. 4 is an exploded view of an alloy button for jeans according to a second embodiment of the present invention.

FIG. 4 shows an alternate form of the socket member 10. As illustrated, the socket member 10 comprises a cylindrical socket body 20, an axial mounting hole 21 defined within the socket body 20, a tapered bottom hole 22 at one end of the socket body 20 for guiding the stud A4 into the axial mounting hole 21, a tapered flange 12 outwardly raised from one end of the socket body 20, and a tapered top hole 11 defined within the tapered flange 12 and communicating with the axial mounting hole 21. This structure of socket member 10 saves much material.

Figure 5:
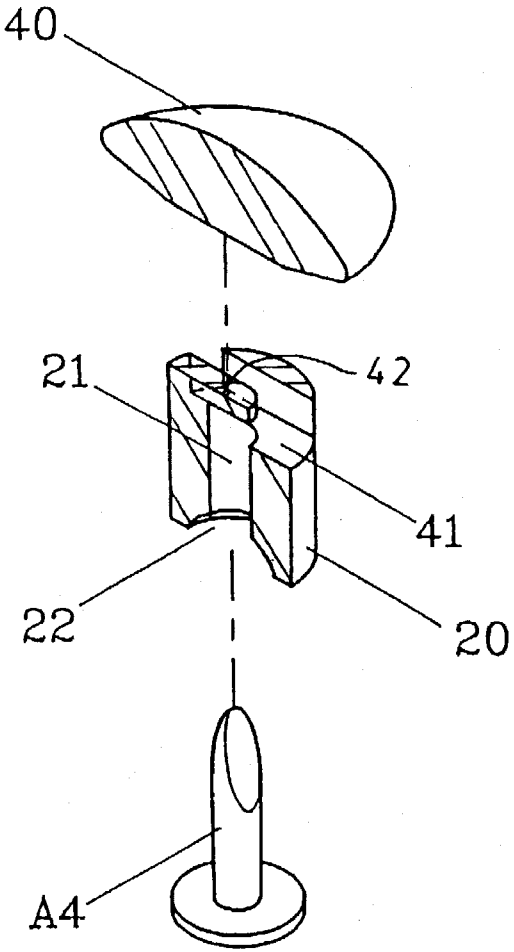
FIG. 5 is an exploded view of an alloy button for jeans according to a third embodiment of the present invention.

FIG. 5 shows another alternate form of the present invention, which is comprised of a socket member 20 and a stud A4 respectively made of alloy by stamping. The socket member 20 comprises a cylindrical socket body 20, a dome-like head 40 at one end of the socket body 20, an axial mounting hole 21, which is a blind hole defined within the socket body 20, a tapered bottom hole 22 at one end of the socket body 20 for guiding the stud A4 into the axial mounting hole 21, a radial coupling hole 41 at one end of the socket body 20 adjacent to the dome-like head 40 and in communication with the axial mounting hole 21, and a reinforcing rib 42 connected between the socket body 20 and the dome-like head 40. Furthermore, patterns or advertising words may be made on the dome-like head 40 for decoration or advertising.

Figure 6A:
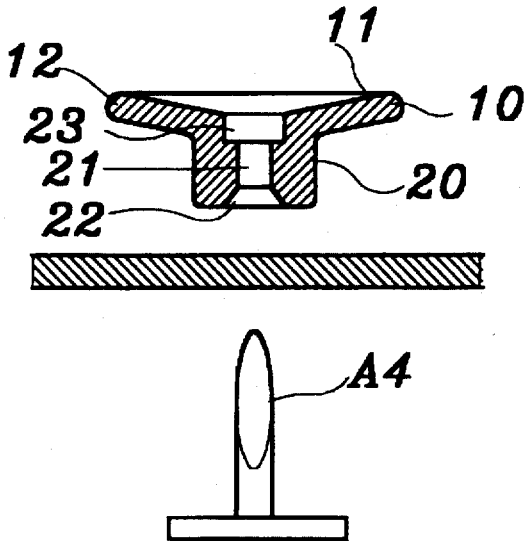
FIG. 6A is a sectional view of the alloy button of FIG. 3, showing the stud and the socket member disposed at two opposite sides relative to the cotton cloth.
Figure 7A:
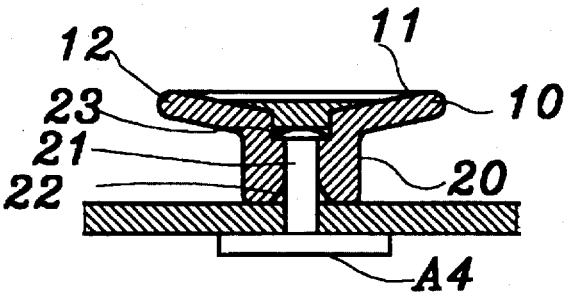
FIG. 7A shows the alloy button of FIG. 6A fastened to the cotton cloth.

FIGS. 6A and 7A show the installation of the alloy button of the embodiment shown in FIG. 3. When the stud A4 and the socket member 10 are attached to the cotton cloth at two opposite sides with the ornamental cap 30 mounted within the tapered top hole 11, the socket member 10 with the ornamental cap 30 are forced against the stud A4 by a press. When the socket member 10 is forced against the stud A4, the stud A4 is forced through the tapered bottom hole 22 into the axial mounting hole 21 and the coupling hole 23. When the stud A4 is forced into the coupling hole 23, its plain end is simultaneously deformed to form a head in the coupling hole 23, and therefore the installation of the alloy button is finished. Because the ornamental cap 30 is mounted within the tapered top hole 11 of the tapered flange 12 end the tapered flange 12 has a smooth outside surface, the alloy button does not hurt when touched by fingers.

Figure 6B:
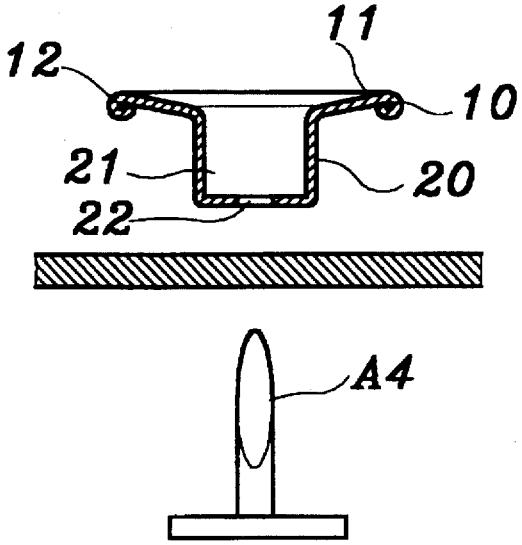
FIG. 6B is a sectional view of the alloy button of FIG. 4, showing the stud and the socket member disposed at two opposite sides relative to the cotton cloth.
Figure 7B:
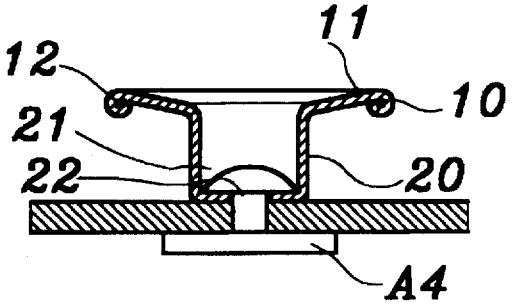
FIG. 7B shows the alloy button of FIG. 6B fastened to the cotton cloth.

FIGS. 6B and 7B show the installation of alloy button of the embodiment shown in FIG. 4. The installation of the alloy button of the embodiment shown in FIG. 4 is similar to that of the alloy button of the embodiment shown in FIG. 3.

Figure 6C:
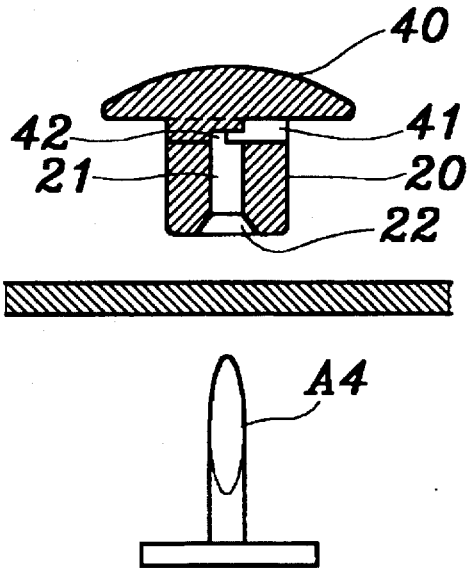
FIG. 6C is a sectional view of the alloy button of FIG. 5, showing the stud and the socket member disposed at two opposite sides relative to the cotton cloth.
Figure 7C:
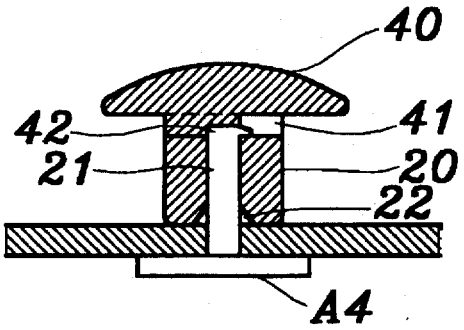
FIG. 7C shows the alloy button of FIG. 6C fastened to the cotton cloth.

FIGS. 6C and 7C show the installation of the alloy button of the embodiment shown in FIG. 5. When the stud A4 and the socket member 10 are attached to the cotton cloth at two opposite sides, the socket member 10 is forced against the stud A4 by a press, causing the stud A4 inserted through the tapered bottom hole 22 into the axial mounting hole 21. At the same time, the plain end of the stud 4A is deformed and forced into engagement with the radial coupling hole 41, and therefore the alloy button is installed.

While only few embodiments of the present invention have been shown and described, it will be understood that various modifications and changes could be made without departing from the spirit and scope of the invention disclosed.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An alloy button comprising:

a stud having a plain end;

a socket member made by die casting and including a cylindrical socket body, a dome-like head at one end of said socket body, an axial mounting hole, said axial mounting hole is a blind hole defined within said cylindrical socket body, a tapered bottom hole at one end of said axial mounting hole for guiding said plain end of said stud into said axial mounting hole, a radial coupling hole at one end of said socket body adjacent to said dome-like head and in communication with said axial mounting hole for retaining said plain end of said stud as said plain end is deformed by force, a reinforcing rib connected between said socket body and said dome-like head, and said reinforcing rib disposed within said axial mounting hole and extending toward said radial coupling hole.

* * * * *